US005675876A

United States Patent [19]

Benedict et al.

[11] Patent Number: 5,675,876

[45] Date of Patent: Oct. 14, 1997

[54] BURIAL CASKET WITH MEMORABILIA TRAY PIVOTABLE INTO AND OUT OF THE CASKET

[75] Inventors: Dale G. Benedict, Marysville, Ohio; Patrick Michael Saaf, Batesville, Ind.; Frank R. Wilgus, Powell, Ohio

[73] Assignee: Batesville Casket Company, Inc., Batesville, Ind.

[21] Appl. No.: 611,921

[22] Filed: Mar. 6, 1996

[51] Int. Cl.[6] ..... A61G 17/00

[52] U.S. Cl. ..... 27/2; 27/1

[58] Field of Search ..... 27/1, 2, 3, 4, 5, 27/6, 7, 8, 35; 220/335, 23.86, 478, 479

[56] References Cited

U.S. PATENT DOCUMENTS

| | | |
|---|---|---|
| D. 87,176 | 6/1932 | Treiber . |
| D. 278,609 | 4/1985 | Satterelli . |
| 331,982 | 12/1885 | Lovett . |
| 443,209 | 12/1890 | Ripson . |
| 545,176 | 8/1895 | Ruebekam . |
| 565,282 | 8/1896 | Kolle . |
| 983,963 | 2/1911 | Wetmore . |
| 1,858,539 | 5/1932 | Dewey . |
| 2,075,859 | 4/1937 | Martin . |
| 2,676,383 | 4/1954 | Lipman . |
| 3,435,494 | 4/1969 | Bernard . |
| 4,252,387 | 2/1981 | Wagner . |
| 4,324,026 | 4/1982 | Craft . |
| 4,457,054 | 7/1984 | Craft et al. . |
| 4,697,316 | 10/1987 | Semon . |
| 5,088,167 | 2/1992 | Rahe . |
| 5,090,785 | 2/1992 | Stamp . |
| 5,215,365 | 6/1993 | Godin . |
| 5,238,301 | 8/1993 | Brady . |
| 5,253,838 | 10/1993 | Spykerman . |
| 5,330,146 | 7/1994 | Spykerman . |
| 5,379,499 | 1/1995 | Jackson . |
| 5,426,573 | 6/1995 | Jenkins . |

FOREIGN PATENT DOCUMENTS

| | | |
|---|---|---|
| 2263388 | 7/1993 | United Kingdom . |

*Primary Examiner*—Kien T. Nguyen
*Attorney, Agent, or Firm*—Wood Herron & Evans, L.L.P.

[57] ABSTRACT

A burial casket comprises a shell, a cap enclosing the shell and memorabilia tray pivotally connected to the shell with a linkage. The tray is pivotally movable from a position inside the shell to a position outside the shell when the cap is open. The tray is maintained in an upright, upwardly facing orientation during movement of the tray. The linkage comprises a pair of links, each link being pivotally connected at one link end to an end of the tray and at the other link end to the shell. The tray is generally elongated, rectangular in shape and shallow and includes a plurality of individual compartments therein. The tray is oriented lengthwise generally parallel to the length of the shell and is mounted to a side wall of the shell. The tray may include individual covers enclosing the individual compartments.

10 Claims, 1 Drawing Sheet

BURIAL CASKET WITH MEMORABILIA TRAY PIVOTABLE INTO AND OUT OF THE CASKET

FIELD OF THE INVENTION

This invention relates generally to burial caskets, and more particularly to a burial casket having a memorabilia tray pivotable into and out of the casket for placing mementos therein.

BACKGROUND OF THE INVENTION

In the past, caskets, whether fabricated from wood or metal, have not provided any designated, easily accessible receptacle or compartment for either the placement of personal effects of the deceased therein or the inclusion of mementos of memorialization therein by the deceased's family and friends.

Earlier attempts at solving this shortcoming generally took the form of placing a small memento box into the casket alongside the deceased. However, such memento boxes often appear as an afterthought, simply placed alongside the deceased in the casket somewhat haphazardly. Thus, no designated receptacle or compartment which was an integral part of the casket was provided which could be utilized by the family to commemorate the passing of the deceased.

One attempt at solving this problem is disclosed in copending application Ser. No. 08/438,441, entitled Casket Having Memorabilia Compartment, assigned to the assignee of the present invention, the entire substance of which is hereby incorporated by reference herein as if fully set forth in its entirety. In that application, various embodiments of caskets including integral memorabilia compartments for the placement, display and storage therein of personal effects and mementos of memorialization of the deceased are disclosed. The present invention is an improvement upon those various casket embodiments.

Accordingly, it is a major objective of the present invention to provide a casket having a memorabilia means for the placement, display and storage therein of mementos and which does not present the haphazard appearance of prior memento boxes simply placed alongside the deceased in the casket.

SUMMARY OF THE INVENTION

In accordance with the stated objectives, the present invention is a burial casket comprising a shell, a cap enclosing the shell and a memorabilia tray pivotally connected to the shell with a linkage, the tray being pivotally movable from a position inside the shell to a position outside the shell when the cap is open.

The tray is maintained in an upright, upwardly facing orientation during movement of the tray from inside the shell to outside the shell. The linkage comprises a pair of links, each link of the pair of links being pivotally connected at one link end to an end of the tray and at the other link end to the shell. Each link is L-shaped having a leg and a foot, the foot being pivotally connected to the tray and the leg being pivotally connected to the shell.

The tray is generally elongated, rectangular in shape and shallow and includes a plurality of individual compartments therein. The tray is oriented lengthwise generally parallel to the length of the shell and is mounted to a side wall of the shell. A rearward facing surface of the tray abuts a forward facing surface of the shell side wall stopping continued pivoting movement of the tray when moving the tray from inside the shell to outside the shell. The tray rearward facing surface is inclined slightly from vertical such that when the tray rearward facing surface is abutted against the shell side wall forward facing surface a forward facing edge of the tray is tilted downward slightly relative to a rearward facing edge of the tray to facilitate viewing of objects in the tray. A forward facing surface of the tray abuts a rearward facing surface of the shell side wall stopping continued pivoting movement of the tray when moving the tray from outside the shell to inside the shell.

The shell side wall has an upwardly facing flange having a pair of recesses formed therein. Each recess of the pair of recesses accommodates one link of the pair of links when the tray is positioned outside the shell thereby facilitating closing of the cap upon the shell.

The tray includes individual covers enclosing the individual compartments.

The main advantage of the present invention is that a casket is provided having a memorabilia means for the placement, display and storage therein of mementos and which does not present the haphazard appearance of prior memento boxes simply placed alongside the deceased in the casket.

These and other objects and advantages of the present invention will become more readily apparent during the following detailed description taken in conjunction with the drawings herein, in which:

DETAILED DESCRIPTION OF THE INVENTION

Figure 1:
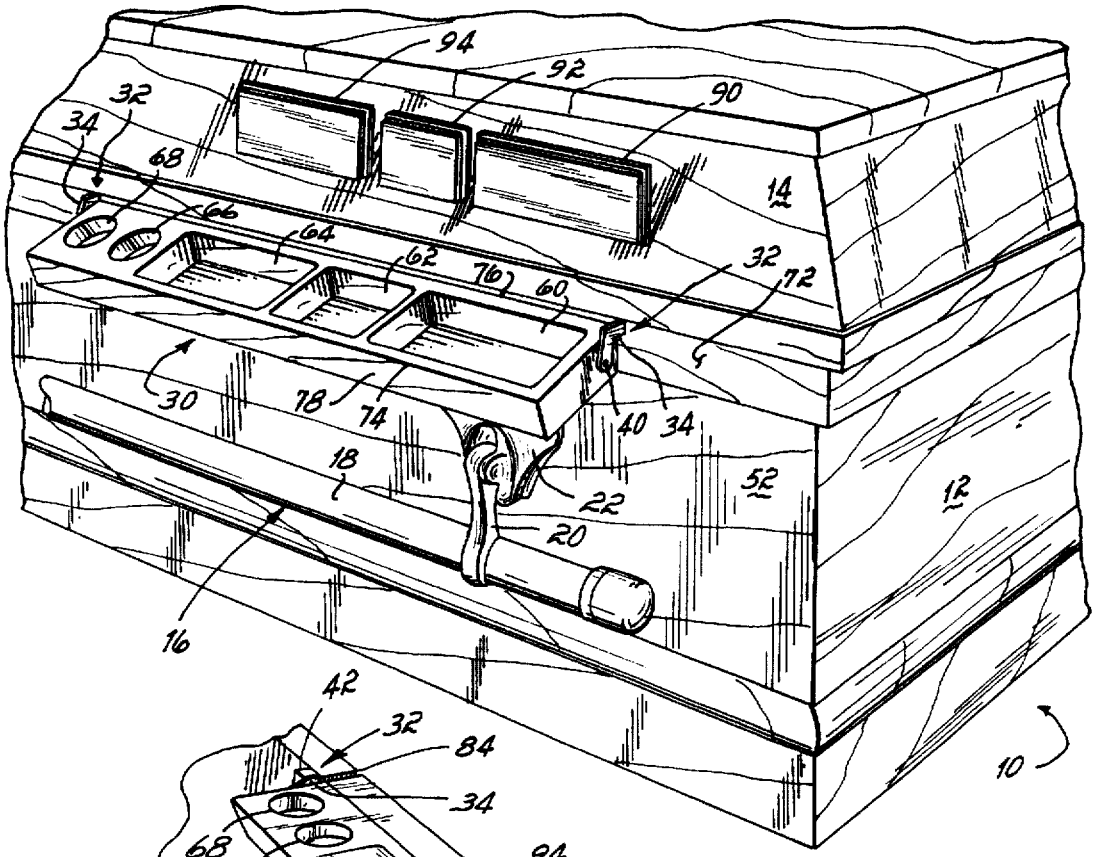
FIG. 1 is a partial perspective view of a casket according to the principles of the present invention with the memorabilia tray extended outside the casket shell.

Referring first to FIG. 1, there is illustrated a casket 10 according to the principles of the present invention. The casket 10, illustrated as wood but it will be appreciated that metal caskets are contemplated as being within the scope of the present invention, includes a shell 12 and a cap 14 closeable thereon. Handling structure 16 takes the form of an elongated handle bar 18 connected to arms 20 in turn connected to escutcheon plates 22 which are themselves connected to the shell 12 with fasteners (not shown).

Referring now to all the FIGS., a memorabilia tray 30 is pivotally mounted to the shell 12 via linkage 32. As is seen in the FIGS., the tray 30 is able to be maintained in an upright, upwardly facing orientation during movement of the tray from inside the shell 12 to outside the shell 12 so that the contents of the tray are not disturbed. The linkage 32 comprises a pair of links 34, 34. Each link 34 is pivotally connected at one link end to an end of the tray 30 and at the other link end to the shell 12. More particularly, each link 34 is L-shaped and has a leg 36 and a foot 38. The foot 38 is pivotally connected to the tray 30 as with pin 40 and the leg 36 is pivotally connected to a block 42 as with pin 44. Block 42 is in turn secured to a rearward facing surface 50 of side wall 52 of shell 12 with screws 54 or the like.

Figure 2:
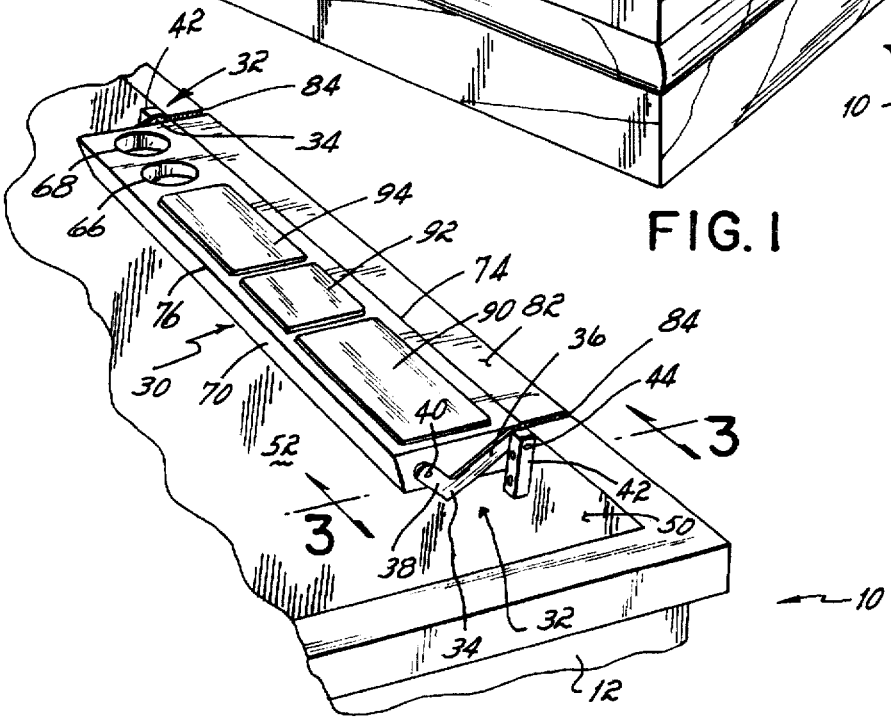
FIG. 2 is a view similar to FIG. 1 but with the memorabilia tray retracted inside the casket shell.
Figure 3:
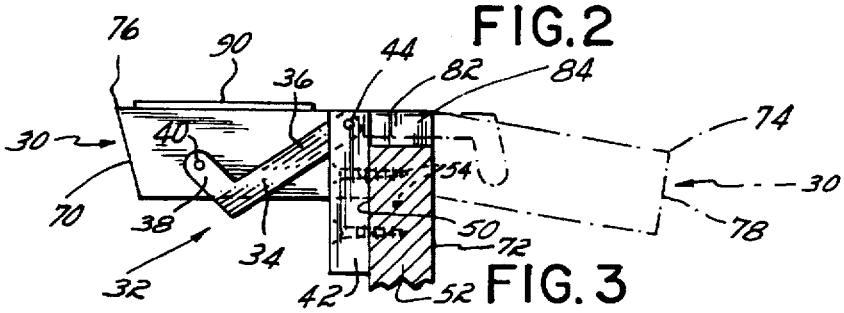
FIG. 3 is a view taken along line 3—3 of FIG. 2.

Tray 30 is generally elongated, rectangular in shape and shallow and includes a plurality of individual compartments 60, 62, 64, 66, 68 therein. The interiors or bottoms of the compartments may be covered with decorative fabric, such as velvet or the like, as may be the ends of the tray 30. The tray 30 is preferably oriented lengthwise generally parallel to the length of the shell 12 and, as mentioned above, to side wall 52 of shell 12. The tray 30 may be fabricated from the same type of wood as is selected for the casket 10, and finished to match. A rearward facing surface 70 of the tray 30 abuts a forward facing surface 72 of the shell side wall 52 stopping continued pivoting movement of the tray when moving the tray 30 from inside the shell 12 to outside the shell 12 (FIG. 3). The rearward facing surface 70 is preferably inclined slightly from vertical such that when the tray rearward facing surface 70 is abutted against the shell side wall forward facing surface 72 a forward facing edge 74 of the tray 30 is tilted downward slightly relative to a rearward facing edge 76 of said tray 30 to facilitate viewing of objects in the tray 30 (FIGS. 1 and 3). A forward facing surface 78 of said tray 30 abuts the rearward facing surface 50 of said shell side wall 52 stopping continued pivoting movement of the tray 30 when moving the tray 30 from outside the shell 12 to inside the shell 12 (FIG. 3). In this position (inside the shell 12) the top surface of the tray 30 is flush with the upwardly facing flange 82 of the shell side wall 52, which flange 82 includes a pair of recesses 84, 84 formed therein (FIG. 2). Each recess 84 accommodates one of the links 34, 34 when the tray is positioned outside the shell (FIGS. 1 and 3) thereby facilitating closing of the cap 14 upon the shell 12.

As shown in FIGS. 1 and 2, the tray 30 may include individual covers 90, 92 and 94 for enclosing the individual compartments 60, 62 and 64 respectively.

Those skilled in the art will readily recognize numerous adaptations and modifications which can be made to the present invention which will result in an burial casket with pivoting memorabilia tray, yet all of which will fall within the spirit and scope of the present invention as defined in the following claims. Accordingly, the invention is to be limited only by the scope of the following claims and their equivalents.

What is claimed is:

1. A burial casket comprising:

a casket shell;

a cap enclosing said casket shell; and a memorabilia tray pivotally connected to said casket shell with a linkage, said tray being pivotally movable from a position inside said casket shell to a position outside said casket shell when said cap is open.

2. The casket of claim 1 wherein said tray is maintained in an upright, upwardly facing orientation during movement of said tray from inside said shell to outside said shell.

3. The casket of claim 2 wherein said linkage comprises a pair of links, each link of said pair of links being pivotally connected at one link end to an end of said tray and at the other link end to said shell.

4. The casket of claim 3 wherein said tray is generally elongated, rectangular in shape and shallow and includes a plurality of individual compartments therein, said tray being oriented lengthwise generally parallel to the length of said shell and being mounted to a side wall of said shell.

5. The casket of claim 4 wherein a forward facing surface of said tray abuts a rearward facing surface of said shell side wall stopping continued pivoting movement of said tray when moving said tray from outside said shell to inside said shell.

6. The casket of claim 4 wherein said tray includes individual covers enclosing said individual compartments.

7. A burial casket comprising:

a shell;

a cap enclosing said shell; and a memorabilia tray pivotally connected to said shell with a linkage, said tray being pivotally movable from a position inside said shell to a position outside said shell when said cap is open;

wherein said tray is maintained in an upright, upwardly facing orientation during movement of said tray from inside said shell to outside said shell;

wherein said linkage comprises a pair of links, each link of said pair of links being pivotally connected at one link end to an end of said tray and at the other link end to said shell; and wherein each said link of said pair of links is L-shaped having a leg and a foot, said foot being pivotally connected to said tray and said leg being pivotally connected to said shell.

8. A burial casket comprising:

a shell;

a cap enclosing said shell; and a memorabilia tray pivotally connected to said shell with a linkage, said tray being pivotally movable from a position inside said shell to a position outside said shell when said cap is open;

wherein said tray is maintained in an upright, upwardly facing orientation during movement of said tray from inside said shell to outside said shell;

wherein said linkage comprises a pair of links, each link of said pair of links being pivotally connected at one link end to an end of said tray and at the other link end to said shell;

wherein said tray is generally elongated, rectangular in shape and shallow and includes a plurality of individual compartments therein, said tray being oriented lengthwise generally parallel to the length of said shell and being mounted to a side wall of said shell; and wherein a rearward facing surface of said tray abuts a forward facing surface of said shell side wall stopping continued pivoting movement of said tray when moving said tray from inside said shell to outside said shell.

9. The casket of claim 8 wherein said tray rearward facing surface is inclined slightly from vertical such that when said tray rearward facing surface is abutted against said shell side wall forward facing surface a forward facing edge of said tray is tilted downward slightly relative to a rearward facing edge of said tray to facilitate viewing of objects in said tray.

10. A burial casket comprising:

a shell;

a cap enclosing said shell; and a memorabilia tray pivotally connected to said shell with a linkage, said tray being pivotally movable from a position inside said shell to a position outside said shell when said cap is open;

wherein said tray is maintained in an upright, upwardly facing orientation during movement of said tray from inside said shell to outside said shell;

wherein said linkage comprises a pair of links, each link of said pair of links being pivotally connected at one link end to an end of said tray and at the other link end to said shell;

wherein said tray is generally elongated, rectangular in shape and shallow and includes a plurality of individual compartments therein, said tray being oriented lengthwise generally parallel to the length of said shell and being mounted to a side wall of said shell; and wherein said shell side wall has an upwardly facing flange having a pair of recesses formed therein, each recess of said pair of recesses accommodating one link of said pair of links when said tray is positioned outside said shell thereby facilitating closing of said cap upon said shell.

* * * * *